US005109565A

United States Patent [19]

Akin et al.

[11] Patent Number: 5,109,565

[45] Date of Patent: May 5, 1992

[54] VACUWIPE

[75] Inventors: Mickey E. Akin, Bremen, Ga.; James O. Lowery, Ranburne, Ala.

[73] Assignee: Southwire Company, Carrollton, Ga.

[21] Appl. No.: 657,791

[22] Filed: Feb. 20, 1991

[51] Int. Cl.[5] ..... A47L 5/38; B08B 1/02; B08B 5/04

[52] U.S. Cl. ..... 15/309.1; 134/15; 134/21

[58] Field of Search ..... 134/15, 21; 15/306.1, 15/309.1

[56] References Cited

U.S. PATENT DOCUMENTS 4,278,497 7/1981 Mellen ..... 15/309.1

4,591,390 5/1986 Scott et al. ..... 15/309.1

*Primary Examiner*—Theodore Morris

*Assistant Examiner*—Zeinab El-Arini

*Attorney, Agent, or Firm*—James W. Wallis, Jr.; Stanley L. Tate

[57] ABSTRACT

A method and apparatus for removing liquid residues from the surface of a continuously advancing strand or filament by using a plurality of vacuum probes positioned such that they continuously expose the entire surface of such advancing strand or filament to a greatly reduced pressure thereby removing substantially all of such residues from the strand's or filament's surface.

7 Claims, 3 Drawing Sheets

VACUWIPE

TECHNICAL FIELD

The present invention relates to a method and an apparatus for removing liquid residue from the surface of a continuously moving length of elongated material. More particularly, this invention relates to a method and apparatus for the continuous removal of moisture and liquid from the surface of an advancing wire, cable, or filament, such wire, cable or filament hereinafter being referred to as strand.

BACKGROUND ART

When strands are manufactured or processed, they are generally, at some point, either cleaned, lubricated, or cooled with a liquid. Each of these processes can, and usually does, leave a liquid residue on the strand's surface. These residues are typically removed from the strand's surface before the strands are further processed or before they are stored. Industry practice for removing these liquid residues generally falls into one of two basic categories. The first is a mechanical wipe which mechanically removes or wipes liquids from the surface of a strand. The second method is a gaseous blast for "blowing" the residue from the surface of the strand.

Mechanical wipes have the advantage of being very efficient in removing liquid residues so long as the wipes are operated within certain narrow parameters. The surface from which the liquid is being removed must be smooth and regular and contact between the surface of the wipe and the surface being wiped must be maintained in good condition and the surface of the wipe must be configured very closely to the shape of the surface being wiped. In the manufacture of strands, including both mono-strand and bunched or twisted strands, the surfaces cannot always be counted on to be regular or smooth. Surface irregularities are not as much a problem with mono-strands as they are with bunched or twisted strands. With bunched or twisted strands, there is little regular surface for the wipe to contact. Contact with a regular surface is critical to the operation of wiping type liquid removers. The more irregular the surface being wiped, the less effective will be the wiping process. The contact surface of the wipe is also a critical consideration. The point or points where contact is made between the strand and the wipe is a point of friction. This friction will erode the wipe contact surface such that there is a loss of intimate contact between the wipe surface and the strand. This too results in a loss in the efficiency of the wiping process.

The second, or gaseous blast, type of liquid removal system is another which is found in common use in strand manufacturing and processing industries. This liquid removal system relies upon a stream or curtain of high velocity gas, usually air, to blow liquid residue from the surface of a strand. In these systems, the strand is typically passed through devices generically known as "air wipes". These devices comprise a bore through which the strand passes. Co-operating with this bore are nozzles or passageways which direct high velocity streams of air, or some other suitable gas, directly onto the surface of the moving strand. The action of this air on the strand surface is such that it blows the liquid residue from the surface of the strand.

The disadvantages of both of these typically used liquid removing systems is that they only remove a limited amount of liquid from the strands being processed. As was indicated, the mechanical wipe will eventually fail to maintain intimate contact with the strand and the result is a poor fit and an incomplete removal of the liquid from the surface. In the case of bunched or twisted strands, the system is inherently inefficient at best. In the case of the air wipe, a buildup of liquid on the advancing strand which eventually forces its way past the air wipe and remains on the surface of the strand. The surface of strand treated by an airwipe retains a fair amount of moisture thereon. The typical strand surface remains damp even after being treated. Another disadvantage of the airwipe type system is the need for pressure regulating equipment and drying filters in the air or gas lines. Pressure regulators are needed to insure that constant gas flows are directed onto the strands. Drying filters are necessary since compressed air contains unacceptable amounts of moisture and water and when directed, unfiltered, onto the advancing strands, it will actually apply a layer of moisture or liquid onto the strand.

There exists a need for a method and means that will more efficiently remove liquid residues from the surface of a moving strand. It is this need that is addressed by the present invention.

DISCLOSURE OF THE INVENTION

It is a primary object of the present invention to provide a method and apparatus for continuously removing liquid residues from the surface of a continuously advancing elongated strand.

It is a further object of the present invention to provide a method and apparatus for continuously removing liquid residue from the surface of a continuously advancing elongated strand without relying on intimate contact between the strand and the moisture removing apparatus.

It is a further object of the present invention to provide a method and apparatus for more effectively removing liquid residue from the surface of an advancing elongated strand than is provided by a positive pressure, gaseous blast, moisture removing system.

It is a further object of the present invention to provide a method and apparatus for effectively removing liquid residue from the surface of an advancing elongated strand by using a series of vacuum probes to remove said residue.

It is a further object of the present invention to provide a method and apparatus for effectively removing liquid residue from the surface of an advancing elongated strand that can be used on a plurality of sizes of strand without requiring major adjustments to the apparatus.

It is a further object of the present invention to provide a method and apparatus for more effectively removing liquid residue from the surface of an advancing elongated strand than is removed when contact wipe or gaseous blast liquid removal means are employed.

Another object of the present invention is to provide a method and apparatus that can be applied to a plurality of strand sizes without the need for major adjustments of said apparatus.

A primary feature of the present invention is the use of a plurality of individual vacuum probes to remove liquid residue from the surface of a continuously advancing strand.

Another feature of the present invention is a non intimate contact means for removing liquid residue from the surface of a continuously advancing strand.

Another feature of the present invention is the provision of an iris type diaphragm to seal the entrance and exit ends of the vacuum chamber, wherein the strand passes, thereby allowing the invention to be used on many different sizes of wires with only minor adjustments to the vacuum chamber itself.

An advantage of the present invention is the elimination of filters and regulators which are needed when compressed air is used to remove liquid residues from the surface of a continuously advancing strand.

Another advantage of using the present invention is a much dryer strand surface than is typically obtained by using wipe type or gaseous blast type liquid removing means.

Another advantage of the present invention is the ability to process a plurality of wire sizes on the same apparatus without significant apparatus adjustments.

Another advantage of the present invention is its simplicity.

Another advantage of the present invention is its low operating costs.

Another advantage of the present invention is its low initial installation costs.

Other objects, features, and advantages of the present invention will become more readily appreciated and understood when taken together with the following detailed description in conjunction with the accompanying drawings.

BEST MODE OF CARRYING OUT THE INVENTION

Figure 1:
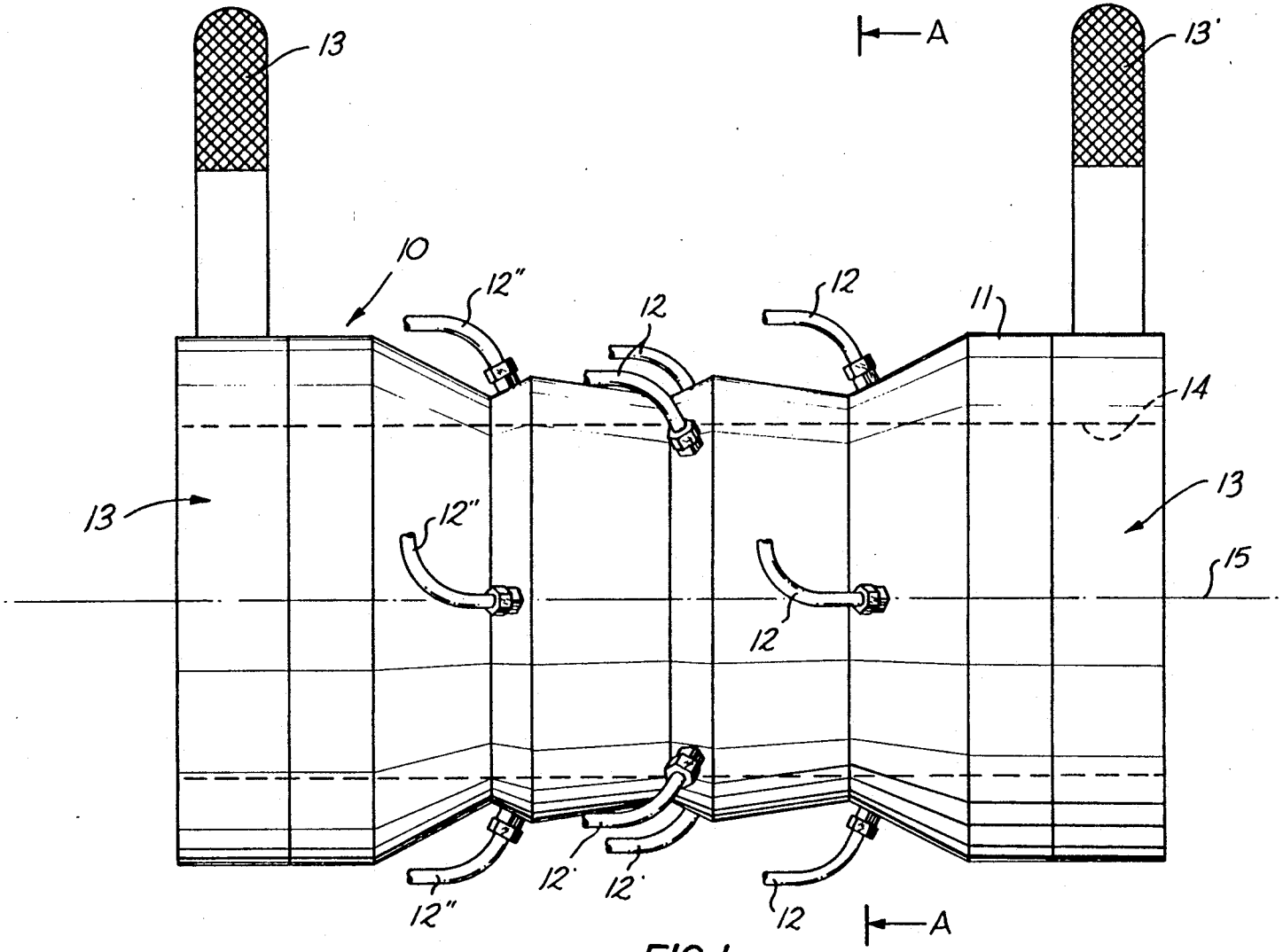
FIG. 1 is a longitudinal view of the apparatus showing its main constituents and their relative positions.

Refer now to FIG. 1 which is a longitudinal view of the apparatus showing its main constituents and their relative positions. Apparatus 10 comprises a substantially cylindrical body 11, said cylindrical body 11 having a substantially axial bore and said cylindrical body 11 having a first and second end and said cylindrical body housing a plurality of substantially identical vacuum suction tubes 12, 12', and 12''. Onto each end of cylindrical body 11 is positioned an iris type closure device 13 which is controlled and operated by iris closure device handle 13'. As strand 15 passes through axial bore 14 of cylindrical body 11, it is positioned by iris type closure device 13. Iris type closure devices 13 function to seal axial bore 14 of cylindrical body 11. This sealed bore 14 is evacuated by a vacuum drawn through vacuum suction tubes 12, 12', and 12'' which pass through the walls of said cylindrical body 11 and cooperate with axial bore 14 forming a vacuum therein. In the present example, there are four vacuum suction tubes positioned within a given plane A, said plane passing through cylindrical body 11, said plane being perpendicular to the direction of travel of advancing strand 15. The vacuum suction tubes in the first such plane are represented by tubes 12. Also in the present example, there are a second and third "bank" of vacuum suction tubes substantially identical in position and function as those described as vacuum suction tubes 12. Each successive "bank" of vacuum suction tubes is rotated approximately 45 degrees from the bank immediately adjacent to it. This 45 degree. offset arrangement allows for the most intimate tube to strand exposure when four vacuum suction tubes are used in each bank. A bank of three suction tubes would require a rotation of 60 degrees to accomplish the maximum strand exposure. Six vacuum suction tubes would require a 30 degree rotation, and so on. The purpose of the rotation of the placement of the vacuum suction tubes is to place the end of each tube as close to an "unvacuumed" strand surface area as is possible. The ends of vacuum suction tubes 12, 12', and 12'' are positioned such that the four vacuum tubes, in the present example, are arranged radially within a given plane all meet at the center of axial bore 14 and form a narrow passageway through which advancing strand 15 passes. The cross section of this passageway is dictated by the diameter of the vacuum suction tubes that are used (see FIG. 2).

Figure 2:
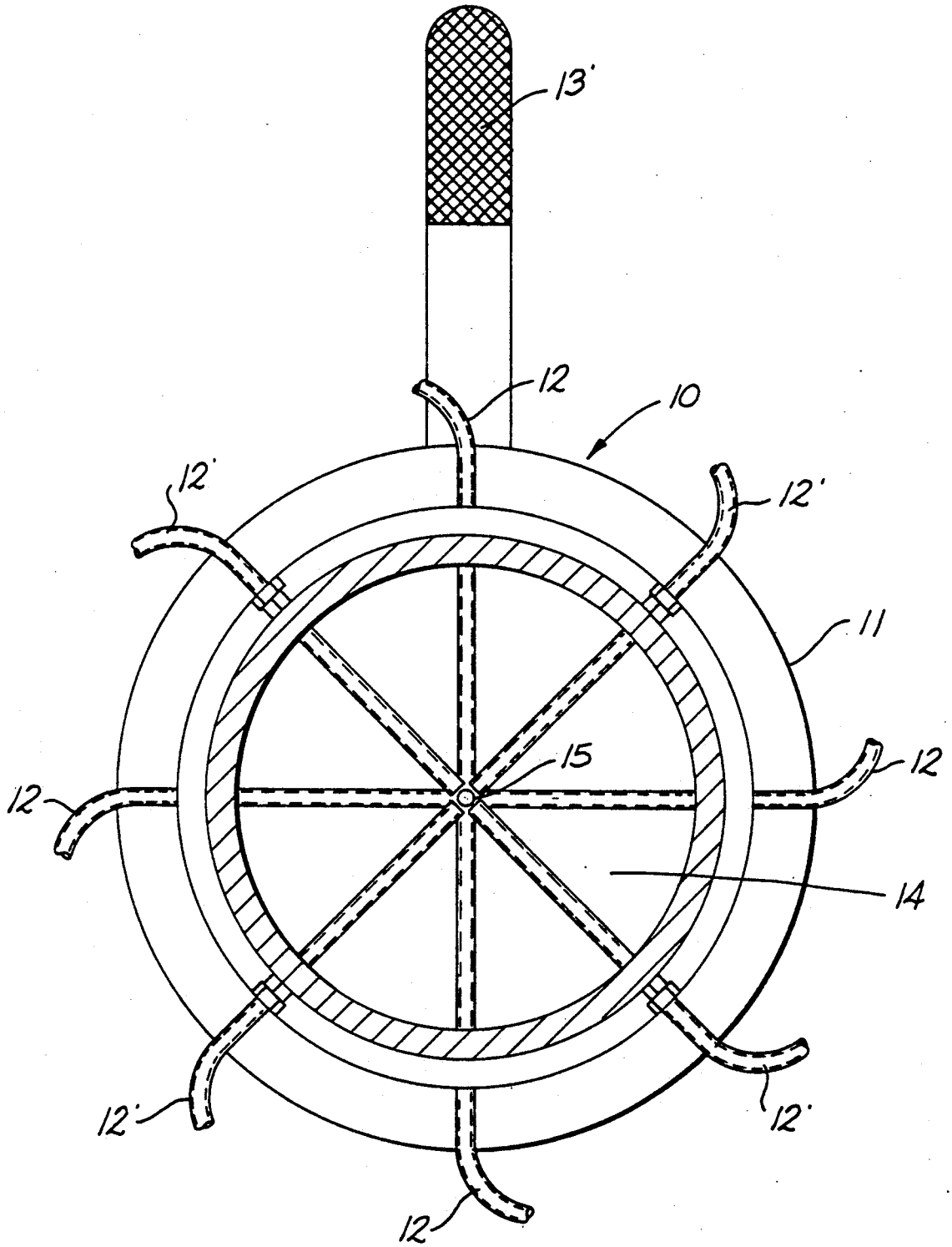
FIG. 2 is a cross sectional view of the apparatus showing the relative positions of the vacuum probes and their spacial relationship with the bore of the apparatus and the wire passing therethrough.

Refer now to FIG. 2 which is a cross sectional view of the apparatus showing the relative positions of the vacuum probes and their spacial relationship with the bore of the apparatus and the wire passing therethrough. Vacuum suction tubes 12, 12' pass through the walls of cylindrical body 11 and are positioned such that those tubes 12 or 12' (or 12'' not shown) substantially meet in the center of axial bore 14 of cylindrical body 11. Within the space defined by the ends of the substantially touching vacuum suction tubes 12 of 12' (or 12'' not shown) passes strand 15. This cross sectional view shows the offset between the radial spacing of tubes 12 and 12' with tubes 12'' being of the same radial offset or rotation relative to the bank nearest it.

Figure 3:
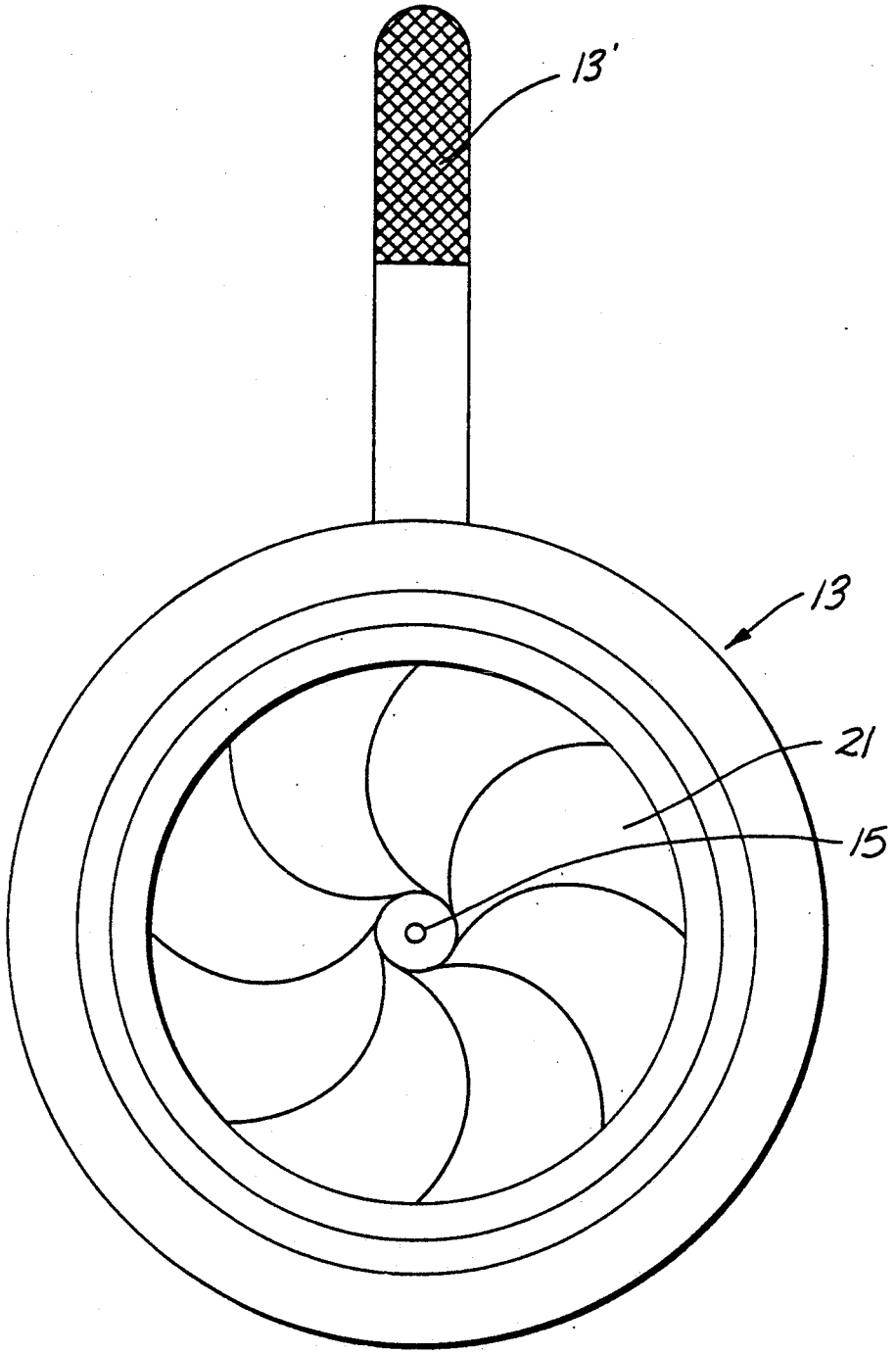
FIG. 3 is a cross sectional view of a typical iris type closure device showing the main common features of such device.

Refer now to FIG. 3, which is a representation of the iris type closure device 13. Iris type closure device 13 comprises a iris type closure device handle 13' and a plurality of iris screen closure leaves 21. Said device 13 is a common and commercially available device and can be purchased under various model or trade names. As iris type closure device handle 13' is rotated clockwise or counterclockwise about the axis of movement of advancing strand 15, iris screen closure leaves 21 are positioned such that the space surrounding advancing strand 15 is increased or decreased. Decreasing said space forms a seal about advancing strand 15 and allows vacuum suction tubes 12' 12', 12'' to remove liquids from the surface of advancing strand 15. Opening said area allows advancing strand 15 to be threaded through axial bore 14 (not shown in this fig.) of cylindrical body 11 (not shown in this Fig.).

Although the invention has been presented with detail of the preferred embodiment, it should be obvious that modifications and changes may be made to the preferred embodiment without departing from the spirit and scope of the invention as described in the specification and claims and reasonable equivalents thereof.

What is claimed is:

1. An apparatus for removing liquids from the surface of a continuously advancing strand, comprising:

an outer body member having a first end and a second end and said body having an axial bore through which passes said advancing strand;

a plurality of vacuum suction tubes positioned such that one end of each such tube cooperates with, and removes liquid residue from, a portion of the surface of said strand passing thereby; and a sealing means positioned on said first end and said second end of said outer body member, said sealing means comprising an iris leaf assembly adjustable orifice.

2. The apparatus of claim 1, wherein said sealing means comprises an adjustable orifice.

3. The apparatus of claim 2, wherein said adjustable orifice is configured to the diameter of the strand passing therethrough.

4. The apparatus of claim 1, wherein said vacuum suction tubes are collectively positioned such that substantially all of the periphery of said strand is exposed to at least one said tube.

5. The apparatus of claim 1, wherein said vacuum suction tubes are positioned in a plane and radially about said advancing strand.

6. An apparatus for removing liquids from the surface of a continuously advancing strand, comprising:

an outer body member having a first and a second end and said body having an axial bore through which passes said advancing strand;

a plurality of vacuum suction tubes, said tubes being connected to a source of vacuum and said tubes being adjustably secured through the walls of said outer body member such that they can be positioned so as to cooperate with, and remove liquid residue from, a portion of the surface of said strand passing thereby; and an iris adjustable sealing means positioned on said first end and said second end of said outer body member, said sealing means being adjustable so as to be closed around and advancing strand and thereby providing a seal at each end of said axial bore.

7. The apparatus of claim 6, wherein said iris adjustable sealing means comprises an adjustable orifice.

* * * * *